US008523490B2

(12) United States Patent
Wilkinson, Jr.

(10) Patent No.: US 8,523,490 B2
(45) Date of Patent: Sep. 3, 2013

(54) TEMPORARY PLATFORM FOR ATTACHMENT TO AN OFFSHORE STRUCTURE

(76) Inventor: Mervin Hale Wilkinson, Jr., Richmond, TX (US)

( * ) Notice: Subject to any disclaimer, the term of this patent is extended or adjusted under 35 U.S.C. 154(b) by 0 days.

(21) Appl. No.: 13/507,272

(22) Filed: Jun. 18, 2012

(65) Prior Publication Data

US 2012/0321393 A1 Dec. 20, 2012

Related U.S. Application Data

(60) Provisional application No. 61/520,926, filed on Jun. 17, 2011.

(51) Int. Cl.
*E02B 17/00* (2006.01)

(52) U.S. Cl.
USPC ..... 405/196

(58) Field of Classification Search
USPC ..... 405/195.1, 204, 211, 196; 166/351, 166/355
See application file for complete search history.

(56) References Cited

U.S. PATENT DOCUMENTS

| | | | | |
|---|---|---|---|---|
| 3,882,650 | A * | 5/1975 | Gugliotta | 52/223.12 |
| 4,276,959 | A | 7/1981 | Barber | |
| 4,490,066 | A | 12/1984 | Hanlon | |
| 4,563,109 | A | 1/1986 | Ortemond | |
| 5,074,382 | A | 12/1991 | Do | |
| 5,716,166 | A * | 2/1998 | Phillips et al. | 405/211 |
| 6,557,666 | B1 * | 5/2003 | Drouin | 182/129 |

FOREIGN PATENT DOCUMENTS

WO WO 2009/117758 10/2009

OTHER PUBLICATIONS

PCT Search Report for PCT/2012/000286 dated Sep. 14, 2012 (11 Pages).

* cited by examiner

*Primary Examiner* — Tara M. Pinnock
(74) *Attorney, Agent, or Firm* — The Matthews Firm

(57) ABSTRACT

Temporary platforms and methods of securing such platforms to an offshore structure include a plurality of clamps secured to an existing portion of the offshore structure at a selected height. A receiver member can be secured to the clamps at a selected horizontal position, and a temporary platform structure can be secured to the receiver member, thereby providing a temporary platform that can be installed, removed, and repositioned, as needed, for a variety of purposes. Such platforms are usable in place of elevating boats and similar vessels, enabling operations to be conducted independent of the depth of the water.

20 Claims, 9 Drawing Sheets

TEMPORARY PLATFORM FOR ATTACHMENT TO AN OFFSHORE STRUCTURE

CROSS-REFERENCE TO RELATED APPLICATIONS

The present application claims priority to the United States Provisional Application, having the Ser. No. 61/520,926, filed Jun. 17, 2011, the entirety of which is incorporated herein by reference.

FIELD

Embodiments described herein relate, generally, to temporary platforms and/or cantilevered decks, attachable to an offshore structure, and readily removable from the structure for repositioning, repurposing, and/or uninstallation. More specifically, embodiments usable within the scope of the present disclosure can include temporary platforms attachable to offshore production platforms, control structures, storage structures, and/or similar offshore structures, usable to perform or facilitate a variety of operations, eliminating the need for the continuous presence of boats (e.g., elevating boats) and/or similar vessels normally used when conducting such operations.

BRIEF DESCRIPTION OF THE DRAWINGS

In the detailed description of various embodiments usable within the scope of the present disclosure, presented below, reference is made to the accompanying drawings, in which.

Figure 1:
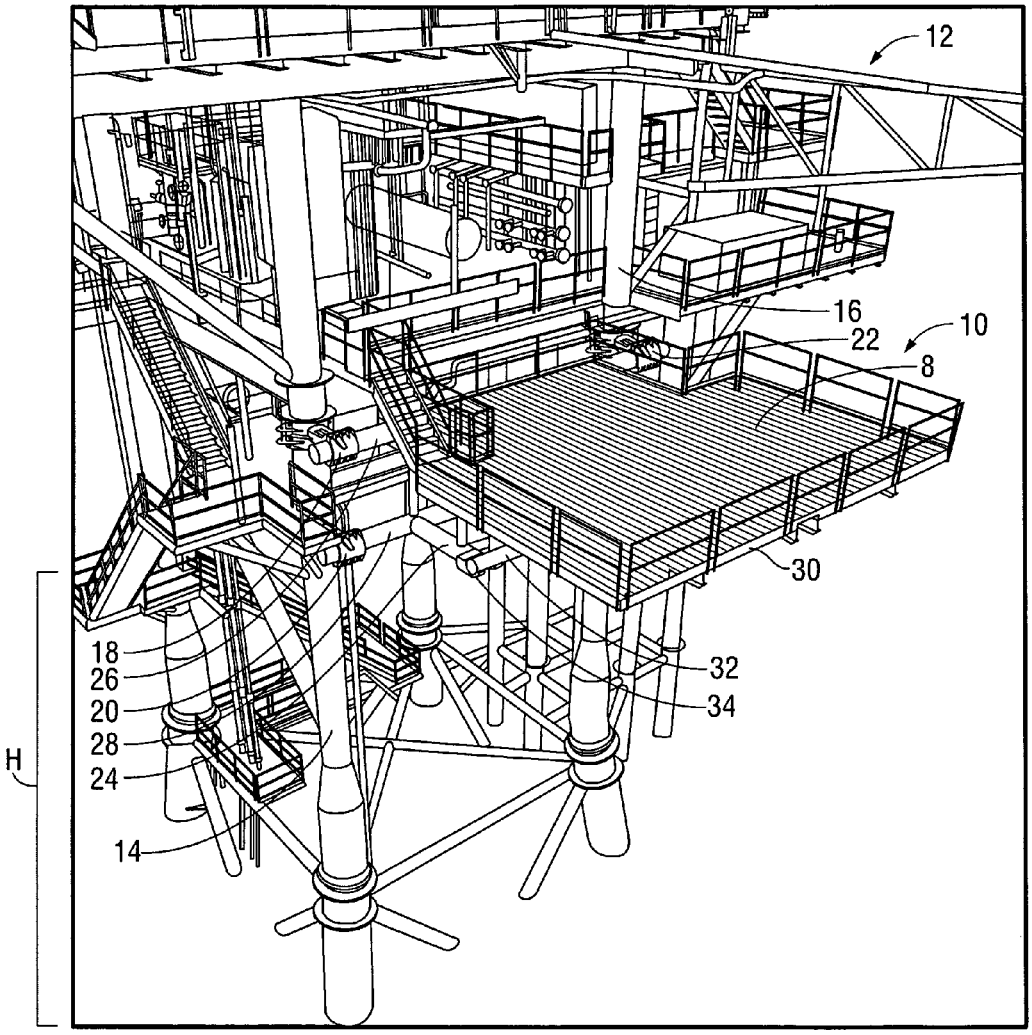
FIG. 1 depicts a perspective view of an embodiment of a temporary platform installed on an offshore structure.

One or more embodiments are described below with reference to the listed Figures.

DETAILED DESCRIPTION OF THE EMBODIMENTS

Before describing selected embodiments of the present invention in detail, it is to be understood that the present invention is not limited to the particular embodiments described herein. The disclosure and description herein is illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments of the invention to one of skill in the art, but are not intended to be manufacturing level drawings or renditions of final products and may include simplified conceptual views, as desired for easier and quicker understanding or explanation of the invention. As well, the relative size and arrangement of the components of each embodiment may differ from that shown and still operate within the spirit of the invention as described throughout the present application.

Moreover, it will be understood that various directions such as "upper", "lower", "bottom", "top", "left", "right", and so forth are made only with respect to explanation in conjunction with the drawings, and that the components may be oriented differently, for instance, during transportation and manufacturing as well as operation. Because many varying and different embodiments may be made within the scope of the inventive concept(s) herein taught, and because many modifications may be made in the embodiments described herein, it is to be understood that the details herein are to be interpreted as illustrative and non-limiting.

Embodiments usable within the scope of the present disclosure relate to platforms, decks, and/or other types of surfaces able to be temporarily (e.g., removably) attached to an offshore structure, such as an oil production platform, control structure, storage structure, or other similar offshore structures. In use, embodiments described herein can be adjusted (e.g., repositioned) on the offshore structure, removed and placed at a different location on the structure (e.g., for use in performing different operations), and/or removed for use with another structure.

Conventionally, when performing repair and maintenance operations, such as welding operations, on an offshore platform or similar offshore structure, work ships and/or other types of vessels must be rented and used for the duration of the operations. Use of a single vessel to perform operations on a platform can cost tens of thousands of dollars per day. Use of a more complex vessel, such as a jack-up rig, derrick barge, etc., can cost as much as one hundred thousand dollars per day, or more. A basic welding operation can require thirty days, or more, to complete, causing the rental costs for the required vessels to render such operations prohibitively expensive, especially when coupled with the additional costs for materials, equipment, personnel, and other related expenses. Further, vessels are subject to wave motion, inclement weather, and other unpredictable and/or uncontrollable circumstances, which can further increase the time and resources required to complete an operation. Additionally, elevating boats and similar vessels are also restricted to operations within a limited depth of water.

Typically, space on an offshore platform is limited, thus permanent or semi-permanent storage and/or placement of welding equipment, as well as various other types of equipment and/or facilities, such as workover equipment, storage areas, living quarters, helipads, and the like is not often practical. However, when a need for such equipment or facilities arises, work ships and/or other types of vessels must be used, as described previously.

Alternatively, decks and/or platforms can be added to existing offshore structures to provide the necessary space for additional operations; however, permanent additions to offshore structures are subjected to cumbersome and costly regulations, and can require long-term use of expensive vessels for installation. Additionally, the addition of decks and/or platforms most commonly requires welding, which is prohibited under certain conditions and/or in proximity to certain types of facilities, or requires that portions of a production platform or similar structure be shut-in while welding operations occur, which can cost hundreds of thousands of dollars per day. Further, the addition of a deck and/or platform to an offshore structure requires engineering specific to the features of one particular offshore structure (e.g., its dimensions, the spacing between and the location of existing support structures).

Embodiments usable within the scope of the present disclosure include decks (e.g., cantilevered decks) and/or platforms that can be temporarily secured to a desired location on an offshore structure, without requiring welding, and are, thus, not subjected to the same regulations and restrictions as permanent additions. The disclosed embodiments can be adjustably and removably secured to any offshore structure, independent of the specific dimensions and/or structural characteristics thereof. Thus, the disclosed embodiments can be usable for a large variety of purposes, and can be removed and/or repositioned (e.g., to be used for a different purpose and/or at a different location) efficiently, thus minimizing the required use of work ships and/or similar vessels. For example, an embodied platform that is intended for use in performing welding operations, could be installed at a selected height and location on an existing offshore structure, through use of a work ship or similar vessel, in as little as a single day. The temporary platform can then be retained on the offshore structure until the welding operations are complete, obviating the conventional costs associated with rental and use of vessels throughout an entire operation. Further, the embodied platform can be sized appropriately and spaced from the offshore structure such that expensive shutting in of the offshore structure during welding operations is unnecessary. After the platform is no longer needed for performance of welding operations, the platform could be uninstalled and removed for installation on another structure at another location, or alternatively, the platform could be repositioned elsewhere on the current offshore structure and used for the same or other purposes. For example, after use as a welding deck, the platform could be lowered and attached closer to the waterline for use as a dive deck, or otherwise repositioned for other purposes. Due to the ability of the disclosed embodiments to be used with any offshore structure, regardless of the dimensions or characteristics thereof, once operations requiring use of a deck and/or platform are completed, the platform could also be removed and transported for use on another offshore structure.

Though the uses of a temporary deck, attachable to various locations on an offshore structure are numerous, specific non-limiting embodiments can be used as coil decks, decks for containing living quarters, storage decks, crane decks (e.g., temporary petrochemical and/or offshore crane pedestals external to an existing platform), helicopter pads, diver support and/or dive intervention decks, paint and/or blast and/or sandblast containment decks, fabrication decks, P&A installation and/or removal decks, wireline decks, welding decks, personnel muster decks (e.g., for emergency gathering), boat landing decks, fire fighting decks, topside and/or bottom survey decks; laundry, shower, and/or galley decks; decks for storage of life boats, wastewater decks, water supply decks, decks for facility construction and/or repair, decks for pipeline tie-in and/or installation and/or umbilical subsea tie-in operations, extensions of existing platforms, platform decommissioning, and/or zero discharge decks. It should be noted that other uses for the embodiments described herein are also possible and that while the embodiments described herein may disclose particular uses, features, and/or equipment, such embodiments are not intended to be limiting with regard to the shape, dimensions, structure, parts, configuration, and/or other elements described.

Referring now to FIG. 1, a perspective view of an embodiment of a temporary platform (10) for use with an offshore structure (12) (e.g., a platform) is shown installed thereon. As described previously, offshore structures usable with the embodiments described herein can include any type of offshore platform, equipment, operations facility, or other structure, including without limitation, offshore production platforms, control structures, storage structures, and similar offshore structures. The depicted offshore structure (12) includes multiple, generally vertical support members (e.g., columns, pillars, etc.), including a first vertical support (14) and a second vertical support (16). The offshore structure (12) also includes multiple horizontal support members, and multiple platforms, decks, and/or other surfaces, which can be supported above the surface of a body of water by the vertical support members. Available deck space on the offshore structure (12) can often be limited by regulation, or by physical and/or financial constraints. Generally, additions to the offshore structure (12) would be subjected to numerous regulatory requirements, would require significant time and expense to construct (generally through extensive welding operations), and such additions must be individually engineered and constructed to be engaged with a particular offshore structure (12) at a specific location thereon, and constructed to meet a single purpose.

The depicted temporary platform (10) is removably secured to two vertical supports (14, 16) of the offshore structure (12) at a selected height (H) using a plurality of clamps of which three clamps (18, 20, 22) are visible. The height (H) for placement of each clamp can be calculated and predetermined based on the characteristics of the offshore structure (12), the platform (10), the operations to be performed, and other similar considerations. Thus, depending on the specific characteristics of the offshore structure (12), e.g., the spacing of the vertical supports (14, 16), the position of any horizontal portions of the structure (12), and the like, the clamps (18, 20, 22) can be positioned at any available height, as needed. Additionally, the depicted temporary platform (10) can accommodate various offshore structures, independent of the spacing between the vertical supports (14, 16), due to the ability of the clamps (18, 20, 22) to be placed with any desired horizontal spacing therebetween, as needed. Specifically, FIG. 1 depicts a temporary platform (10) secured using four clamps: a first clamp (18) and a second clamp (20) secured to a first vertical support (14), and a third clamp (22) and a fourth clamp (not visible in FIG. 1) secured to a second vertical support (16). The clamps (18, 20, 22) are further shown having a receiver member (24) secured thereto, at a selected horizontal position. Specifically, the receiver member (24) is shown having a first elongate horizontal portion (26) engaged by the first and third clamps (18, 22) and a second elongate horizontal portion (28) engaged by the second and fourth clamps (20). Horizontal positioning of the receiver member (24) within the clamps (18, 20, 22) can be used to accommodate for the specific dimensions and/or structural features of the offshore structure (12) (e.g., the spacing between the vertical supports (14, 16) and/or the desired position and/or use of the platform (10)), facilitating use of the depicted embodiment with any type of offshore structure, for any desired purpose. A platform structure (30) is shown engaged with the receiver member (24). Specifically, the receiver member is depicted having a plurality of recessions of which a first recession (34) is visible in FIG. 1. A protruding portion (32) of the platform structure (30) is engaged within the first recession (34). A deck surface (8) is disposed on the platform structure (30), to enable equipment, structures, facilities, and/or various other objects to be placed on the platform structure (30) for use with, by, and/or in conjunction with the offshore structure (12). While FIG. 1 depicts complementary protrusions and recessions usable to engage the platform structure (30) with the receiver member (24), it should be understood that this manner of engagement is only exemplary, and that any manner of connection, securing, and/or association between the platform structure (30) and the receiver member (24) can be used without departing from the scope of the present disclosure.

While the specific configuration of the temporary platform (10) can vary, the depicted embodiment shows each of the clamps (18, 20, 22) having a first portion, with a generally vertical, cylindrical shape, secured around one of the vertical supports (14, 16) of the offshore structure (12), and a second portion, attached to the first portion, shown having a generally horizontal, cylindrical shape, secured around one of the elongate horizontal portions (26, 28) of the receiver member (24). Specifically, the clamps (18, 20, 22) are shown having a central member (e.g., having two sections having the shape of half-cylinders, arranged perpendicular to one another), a first end member (having a half-cylinder shape, shown attached to the central member through use of bolts extending through overlapping flanges of the central and end members), and a second end member (having a half-cylinder shape, shown attached to an opposing end of the central member using bolts extending through overlapping flanges). The central and first end members thereby form a generally vertical, cylindrical shape that is secured about one of the vertical supports (14, 16), while the central and second end members form a generally horizontal, cylindrical shape that is secured about one of the elongate horizontal portions (26, 28) of the receiver member (24).

It should be understood that the configuration of the clamps (18, 20, 22) described above is merely exemplary. Other configurations adapted to secure to and/or around any manner of cylindrical or non-cylindrical portion of an offshore structure and/or receiver member can be used, and configurations adapted to secure to and/or around any manner of vertical or non-vertical portion of an offshore structure and/or any manner of horizontal or non-horizontal portion of a receiver member can be used without departing from the scope of the invention. For example, embodiments usable within the scope of the present disclosure can be secured to platform legs extending in a diagonal direction (e.g., having a batter or double batter), through use of clamps dimensioned and/or shaped for such a purpose, and/or one or more intermediate receiver members positioned between the clamps (18, 20, 22) and the receiver member (24).

FIG. 1 further shows the receiver member (24) having two generally horizontal, elongate portions (26, 28), as described previously, and a centrally located body portion that extends outward from the horizontal portions (26, 28), away from the offshore structure (12). The horizontal position of the body portion can be selected through the placement of the horizontal portions (26, 28) relative to the clamps (18, 20, 22). Alternatively, the body portion could be non-centrally positioned and/or adjustably positioned along the horizontal portions (26, 28). The receiver member (24) can further include multiple recessions or similar portions configured to engage the platform structure (30), of which a first recession (34) is visible in FIG. 1. While the specific configuration of the recessions or other mechanisms for engagement between the receiver member (24) and platform structure (30) can vary, the depicted embodiment includes a generally concave (e.g., C-shaped) recession (34) having an open top configured to receive a protruding portion (32) (e.g., a horizontally extending, generally cylindrical member) of the platform structure (30), such that the protruding portion (32) rests therein, assisted by gravity. In an embodiment, this engagement can include use of one or more fasteners, and/or insertion of one or more portions of the platform structure (30) into one or more corresponding receptacles of the receiver member (24), and/or insertion of one or more portions of the receiver member (24) into one or more receptacles of the platform structure (30).

Figure 2:
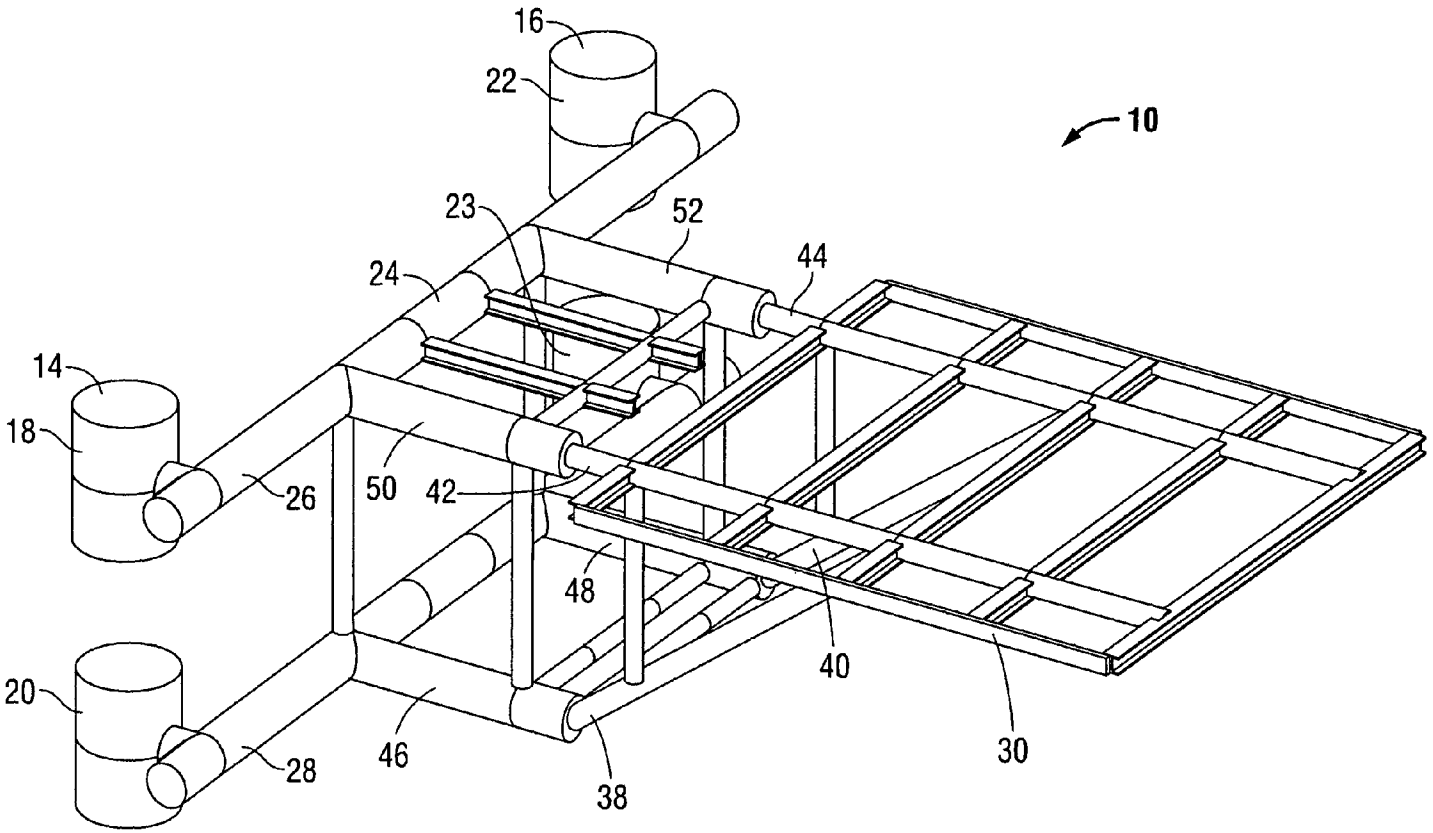
FIG. 2 depicts an isometric view of an alternate embodiment of a temporary platform for use with an offshore structure.

For example, referring to FIG. 2, an isometric view of an alternate embodiment of a temporary platform (10) is shown, for use with an offshore structure, e.g., by securing and/or otherwise engaging the platform (10) to two vertical members (14, 16) of the offshore structure using a plurality of clamps (18, 20, 22, 23). As described previously, two elongate, generally horizontal portions (26, 28) of a receiver member (24) are secured relative to the offshore structure using the clamps (18, 20, 22, 23). Thereafter, a platform structure (30) can be secured to the receiver member (24).

Specifically, FIG. 2 depicts the platform structure (30) having a plurality of protruding members (38, 40, 42, 44) extending therefrom, that are engaged within bores in complementary members (46, 48, 50, 52) of the receiver member (24). While the number, placement, and configuration of engagements between the platform structure (30) and receiver member (24) can vary, FIG. 2 depicts a first protruding member (38) and a second protruding member (40) extending from a lower portion of the platform structure (30) and engaged with bores in corresponding first and second members (46, 48) extending from the receiver member (24) at a height generally equal to that of the second (e.g., lower) horizontal portion (28) thereof. Similarly, a third protruding member (42) and a fourth protruding member (44) extending from an upper portion of the platform structure (30) are shown engaged with corresponding bores of third and fourth members (50, 52), respectively, extending from the receiver member (24) at a height generally equal to that of the first (e.g., upper) horizontal portion (26) thereof. Various fasteners (e.g., pins, threads, clamps, etc.) or other forms of engagement (e.g., threaded engagement, snap and/or force fit, or similar methods) can be used to secure the protruding members (38, 40, 42, 44) within the bores (46, 48, 50, 52).

Returning to FIG. 1, the platform structure (30) is shown as a generally flat, horizontal surface extending from the edge of the offshore structure (12), which is depicted having generally vertical legs, but in various embodiments can include non-vertical legs (e.g., having a batter or a double batter), at the selected height (H). The platform structure (30) is shown having a deck surface (8) placed thereon for accommodating equipment, personnel, facilities, etc. While FIG. 1 depicts the platform structure (30) as a generally rectangular deck having a grated surface (8), with guard rails, an attached stairway, and various other features, it should be understood that the shape, dimensions, and features of the platform structure (30) can vary depending on the dimensions and/or characteristics of the offshore structure (12), and/or the receiver member (24) or clamps (18, 20, 22), and/or depending on the intended purpose of the temporary platform (10).

Once operations requiring use of the temporary platform (10) are completed, the platform (10) can be removed from the offshore structure (12) through disengagement of the clamps (18, 20, 22). If desired, the temporary platform (10) can be repositioned at a different location on the offshore structure (12) (e.g., at a different height), such as when it is desired to use the temporary platform (10) for a different purpose, the clamps (18, 20, 22) can simply be removed from the vertical members (14, 16) and secured to other members of the offshore structure (12), removed from the vertical members (14, 16) and secured to the same members (14, 16) at a different height, or otherwise reconfigured (e.g., by repositioning the receiver member (24) within the clamps (18, 20, 22) to accommodate a different horizontal/positional configuration). Alternatively, the temporary platform (10) can be removed and used with a differing offshore structure having different dimensions and/or structural characteristics, due to the fact that the clamps (18, 20, 22) and receiver member (24)

can accommodate a wide range of offshore structures. As such, a single temporary platform can be usable for a large number of purposes, and can be installed and/or readily repositioned efficiently, without requiring welding or similar permanent means of installation.

Figure 3A:
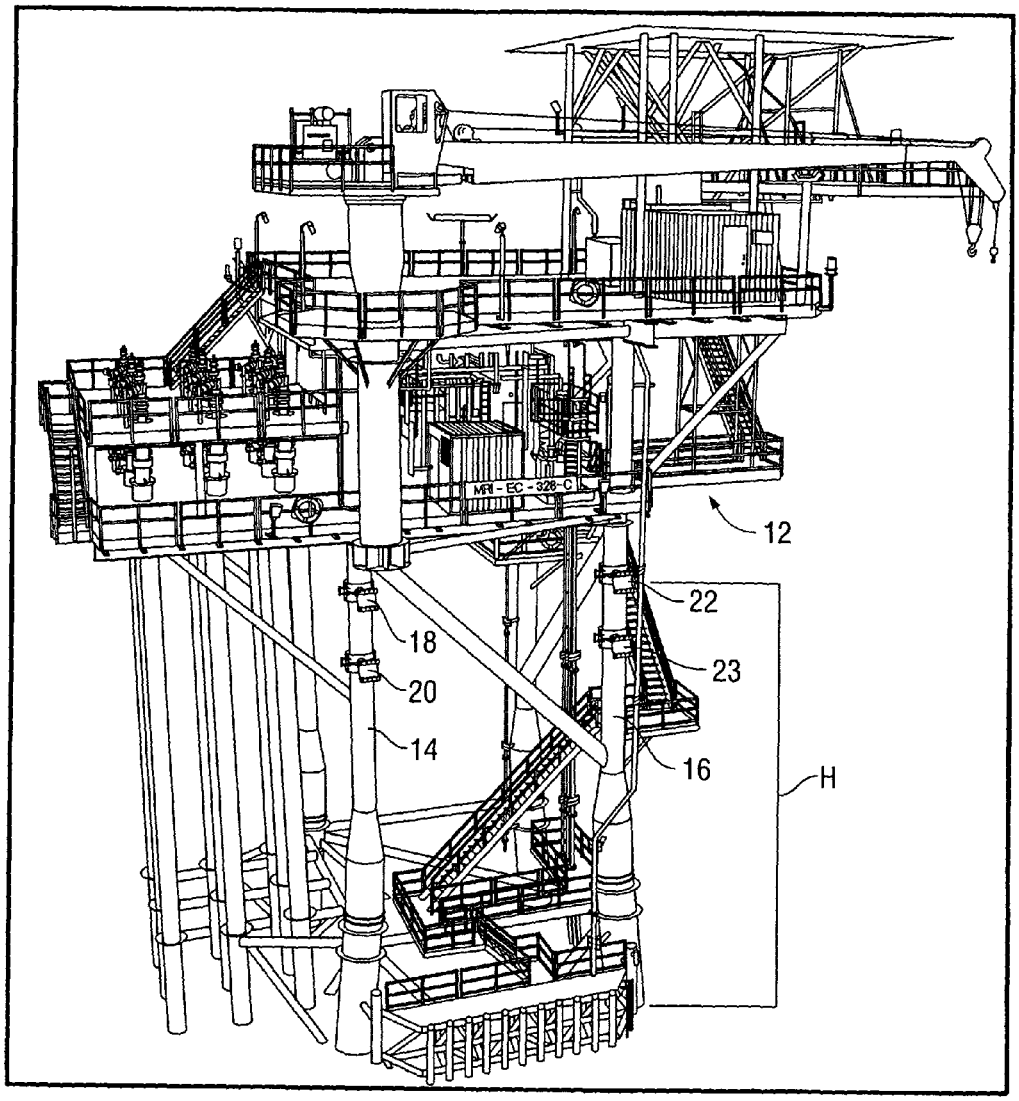
FIGS. 3A through 3G depict perspective views of the temporary platform of FIG. 1 during installation on an offshore structure.

Embodiments of the present temporary platform can be installed through the following method:

Referring to FIG. 3A, a plurality of clamps (18, 20, 22, 23) can be secured to an existing portion of an offshore structure (12) at a selected height (H). Specifically, FIG. 3A shows four clamps (18, 20, 22, 23), of which a first clamp (18) and a second clamp (20) are secured to a first vertical member (14) of the offshore structure (12). The second clamp (20) is shown spaced below the first clamp (18) at a distance sufficient to accommodate a receiver member, as described above. Similarly, a third clamp (22) and a fourth clamp (23) are shown secured to a second vertical member (16) of the offshore structure (12). The fourth clamp (23) is shown spaced below the third clamp (22) at a distance sufficient to accommodate the receiver member. As described previously, the clamps (18, 20, 22, 23) are shown having a first portion secured around the vertical members (14, 16), defined by central and end portions that are engaged around the vertical members (14, 16) by use of bolts extending through overlapping flanges thereof. Installation and/or repositioning of the clamps (18, 20, 22, 23) can be efficiently accomplished using any means known in the art, including use of a work ship or similar vessel, scaffolding, or other methods by which the vertical members (14, 16) of the offshore structure (12) can be accessed.

Figure 3B:
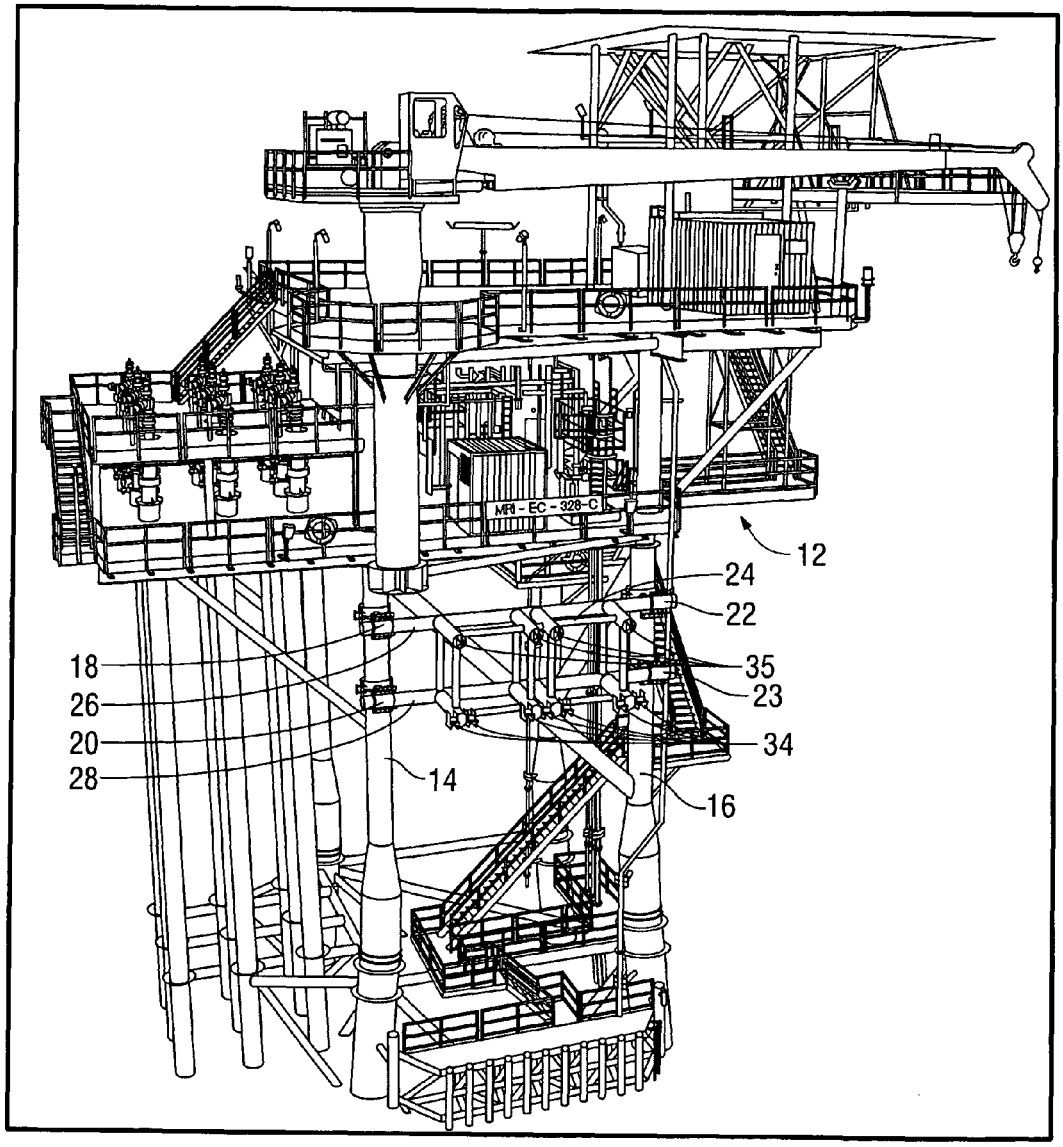

Referring now to FIG. 3B, a receiver member (24) can be secured to the clamps (18, 20, 22, 23) at a selected horizontal position. Specifically, the receiver member is shown having a first (e.g., upper) horizontal portion (26) secured within the first and third clamps (18, 22), and a second (e.g., lower) horizontal portion (28) secured within the second and fourth clamps (20, 23). The clamps (18, 20, 22, 23) are shown having an end portion secured around the horizontal portions (26, 28) of the receiver member (24), by use of bolts extending through overlapping flanges of the end and central portions of the clamps (18, 20, 22, 23). The desired horizontal position of the receiver member (24), and any additional structure to be attached thereto, can be controlled by selectively positioning the horizontal portions (26, 28) relative to the clamps (18, 20, 22, 23), and/or engineering the receiver member (24) to have a desired and/or adjustable position of the body thereof along the horizontal portions (26, 28). Installation and/or repositioning of the receiver member (24) can be efficiently accomplished using any means known in the art, including use of a work ship or similar vessel, scaffolding, or other methods by which the clamps (18, 20, 22, 23) can be accessed.

The receiver member (24) is shown having a plurality of recessions or similar engagement features (34, 35), configured to receive a platform structure, as described previously. Specifically, seven lower recessions (34) are shown, having a concave (e.g., C-shaped) form adapted to receive and hold a horizontal portion of a platform structure, while four upper engagement features (35) are shown having a rod, pin, catch, and/or other type of horizontal member therein, adapted to receive a hook, clamp, clasp, pin, or similar manner of fastener and/or protruding portion of a platform structure. While FIG. 3B depicts various types of recessions and/or engagement features (34, 35) for engagement with a platform structure, it should be understood that any means of engagement therebetween and any arrangement thereof can be used without departing from the scope of the invention.

Figure 3C:
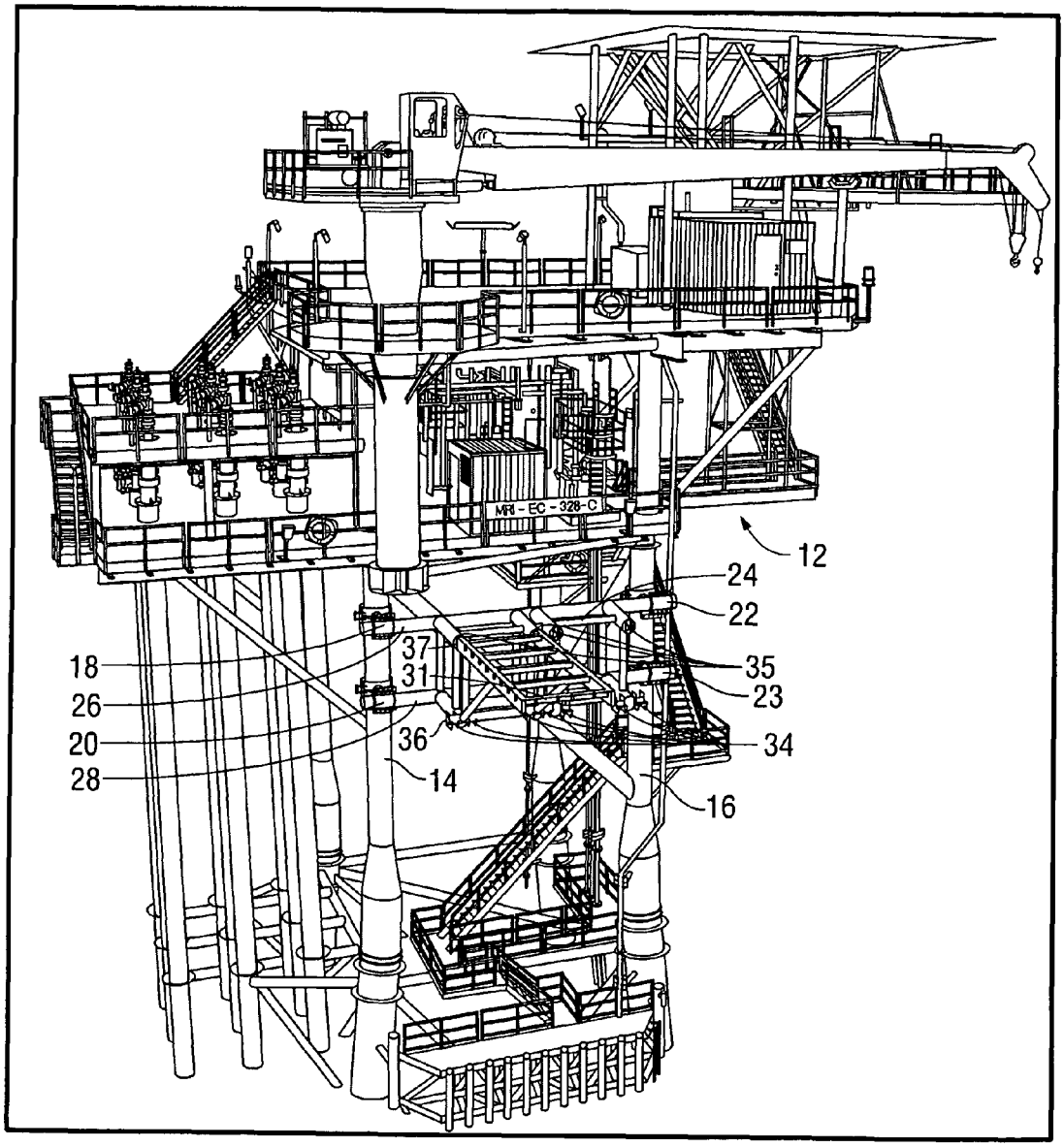

Referring now to FIG. 3C, a first platform structure (31) can be secured to the receiver member (24), and is shown extending outward from a first side thereof. Specifically, a first (e.g., lower) protruding member (36) is shown engaged within four of the lower recessions (34), while a plurality of second (e.g., upper) protruding members (37) are shown engaged within two of the upper engagement features (35). For example, to install the first platform structure (31), the lower protruding member (36) can be placed within the lower recessions (34). Then, the platform structure (31) can be pivoted upward (e.g., through rotation of the lower protruding member (36) within the lower recessions (34)), until the upper protruding members (37) are positioned for engagement within the upper engagement features (35).

Figure 3D:
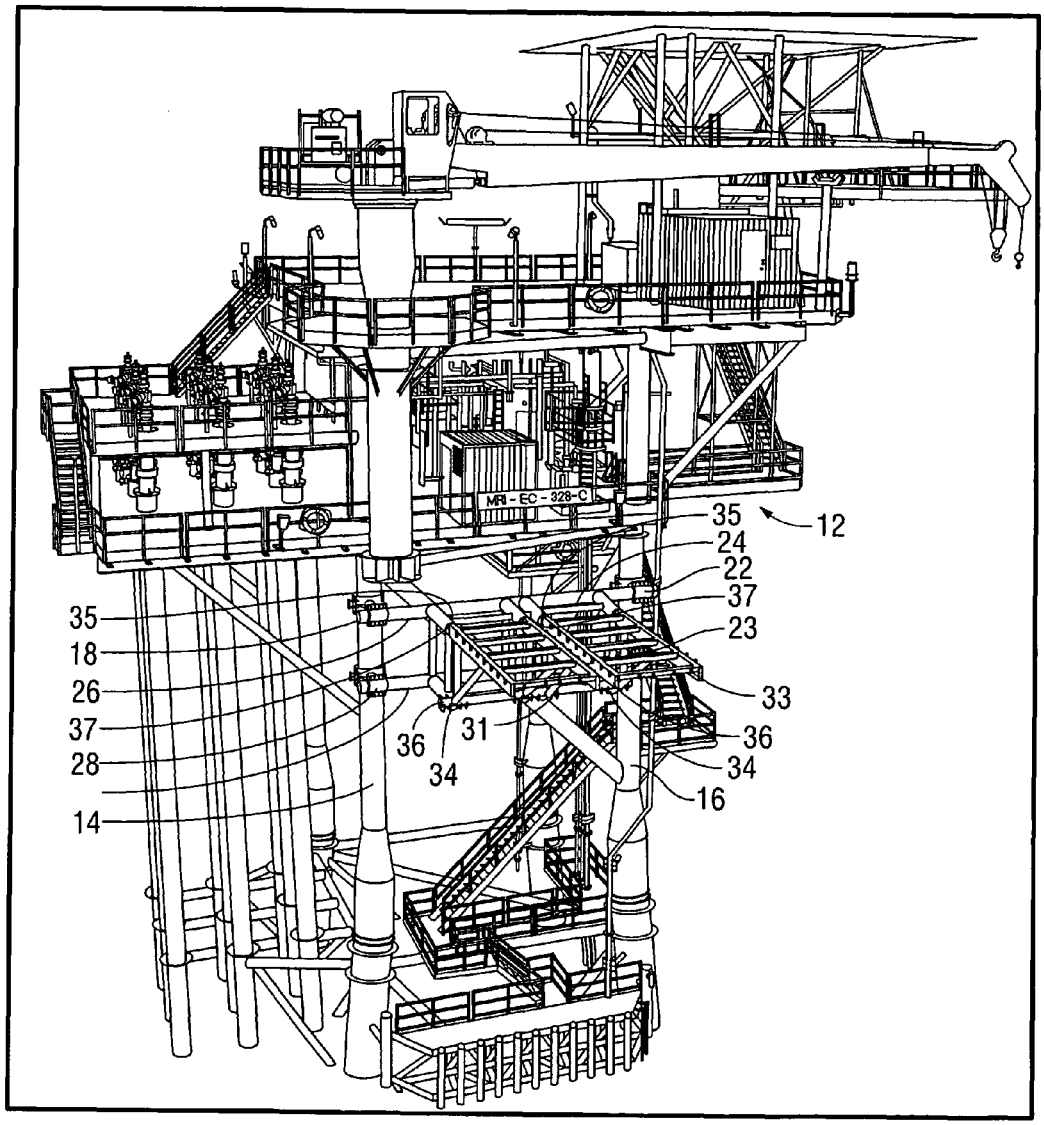

FIG. 3D depicts a second platform structure (33) secured to the receiver member (24), adjacent to the first platform structure (31). A lower protruding member (36) thereof is shown engaged within three of the lower recessions (34) of the receiver member (24), while multiple upper protruding members (37) are shown engaged within two of the upper engagement features (35). In an embodiment, the platform structures (31, 33) can also be engaged and/or secured to one another to form a single platform. It should be understood that while FIGS. 3C and 3D depict two platform structures (31, 33) that are installed separately, in various embodiments, a single platform structure having any shape and/or dimensions can be installed. It should further be understood that any number of platform structures could be secured to the offshore structure (12), generally adjacent to one another, to form a platform having a desired shape and/or dimensions. Installation and/or repositioning of one or both platform structures (31, 33) can be efficiently accomplished using any means known in the art, including use of a work ship or similar vessel, scaffolding, or other methods by which the receiver member (24) can be accessed.

Figure 3E:
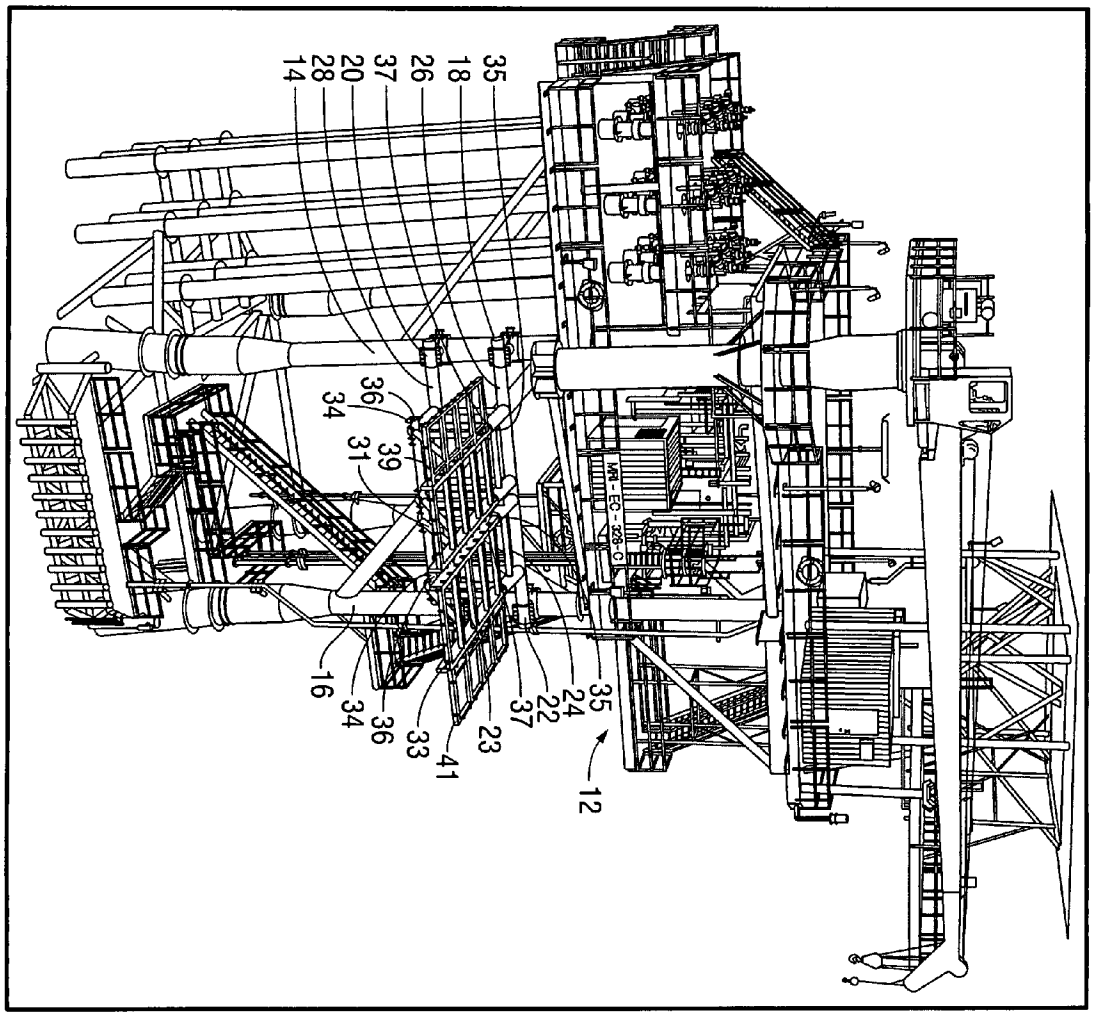

Referring now to FIG. 3E, the first and second platform structures (31, 33) are shown having a first platform extension (39) and a second platform extension (41) secured thereto, respectively, extending from the sides thereof, to provide an overall platform having a width greater than that provided by the platform structures (31, 33) alone. Any manner of fastener and/or connection known in the art can be used to secure the platform extensions (39, 41) to their respective platform structures (31, 33). Alternatively, in an embodiment, the platform structures (31, 33) and extensions (39, 41) can be integrally formed as a single piece, or the platform can include any number of parts having weight and/or dimensions that facilitate transport and/or installation. It should be noted that while FIG. 3E depicts two platform extensions (39, 41), extending from each side of the platform structures (31, 33), in alternative embodiments, a single platform extension could be used, or use of platform extensions could be omitted, depending on the desired size and shape of the platform structure and the operations to be performed.

Figure 3F:
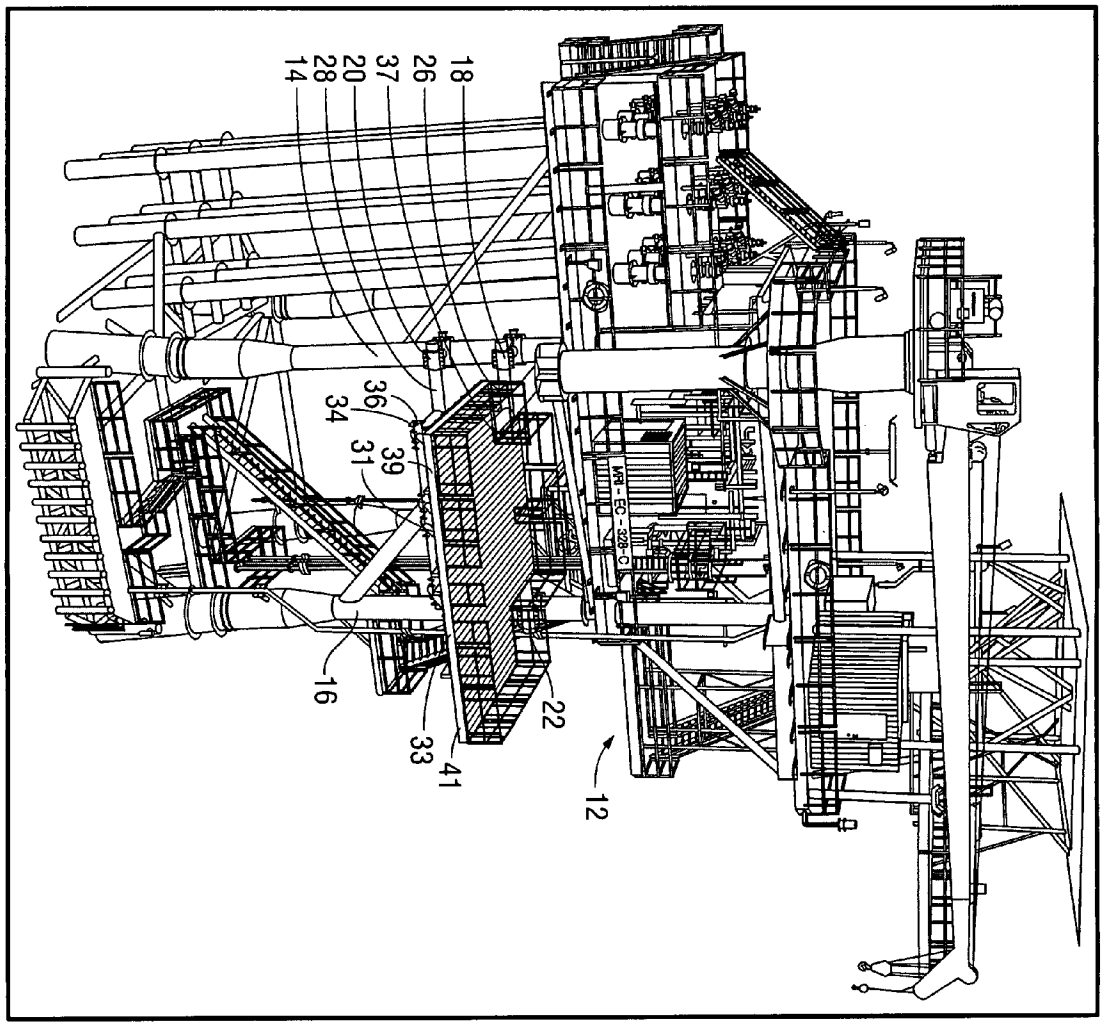

Referring now to FIG. 3F, the platform structures (31, 33) and platform extensions (39, 41) are shown having a deck surface (8) positioned thereon for containing equipment, personnel, facilities, and/or other objects, or otherwise making the upper surface of the platform structures (31, 33) and extensions (39, 41) accessible and useable. Other features, such as guard rails, stairways, handholds, and the like, can be provided to the platform to facilitate use thereof.

Figure 3G:
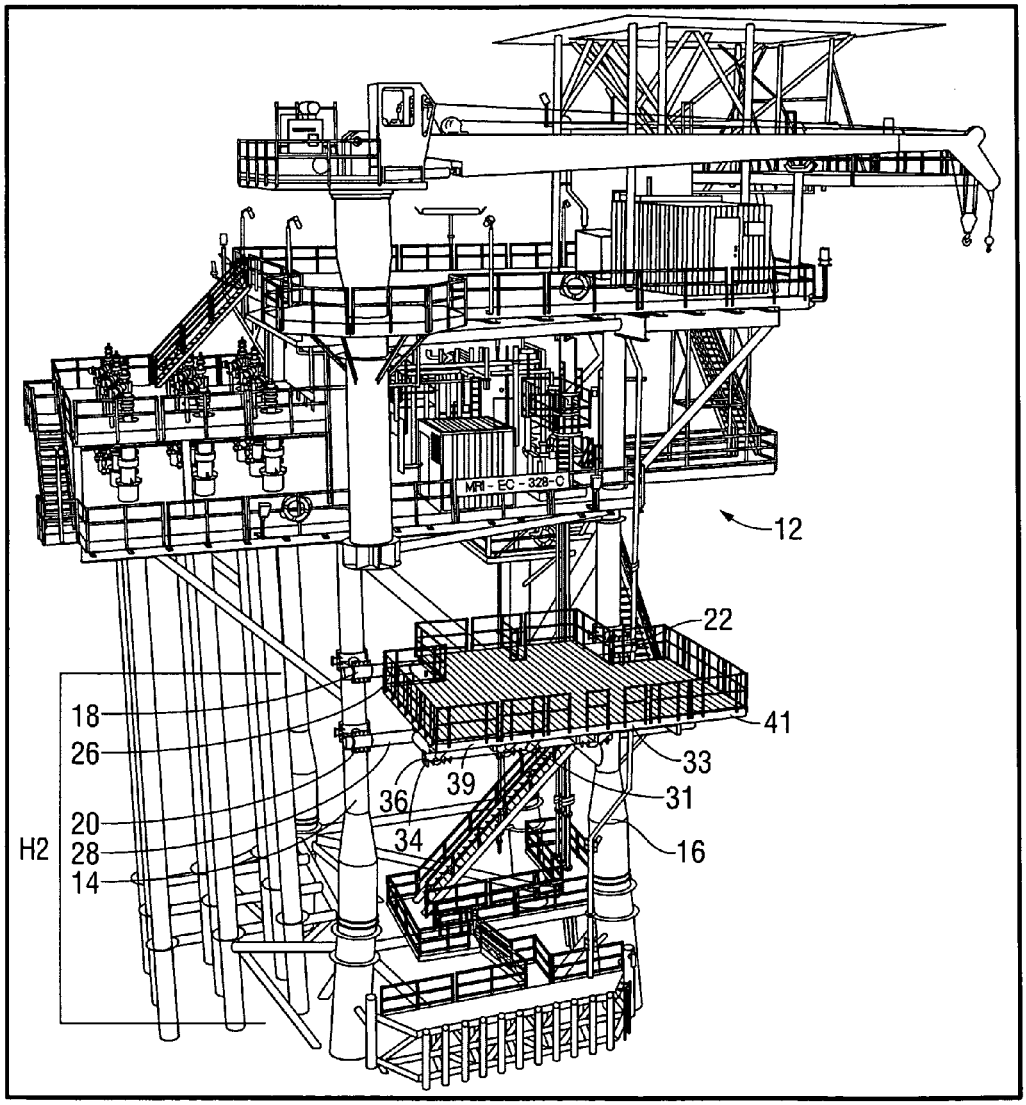

Referring now to FIG. 3G, after installation and/or use thereof, the temporary platform can be readily uninstalled and/or repositioned. Specifically, the clamps (18, 20, 22) are shown secured to the vertical supports (14, 16) of the offshore structure (12) at a second height (H2), lower than the initial height (H, shown in FIG. 3A) thereof, such that the platform structures (31, 33) and extensions (39, 41) extend outward from the offshore structure (12) at the second height (H2). For example, after use of the temporary platform to contain living quarters or similar facilities at the first height, it may be desirable to lower the platform to the second height (H2) for use during dive operations, welding operations, or other similar uses.

To reposition the temporary platform, the platform extensions (39, 41) and platform structures (31, 33) can be removed from the receiver member (24), and the receiver member (24) can be removed from the clamps (18, 20, 22). The clamps (18, 20, 22) can then be repositioned (e.g., removed and lowered) along the vertical support members (14, 16) and/or placed elsewhere on the offshore structure (12). In an embodiment, it can be possible to remove the platform extensions (39, 41) and platform structures (31, 33), while the receiver member (24) remains secured within the clamps (18, 20, 22), then to lower the clamps (18, 20, 22) and receiver member (24). In a further embodiment, it can be possible to move the platform extensions (39, 41), platform structures (31, 33), receiver member (24), and clamps (18, 20, 22, 23) along the vertical support members (14, 16) as a single unit. Removal and/or repositioning of the temporary platform can be performed through the same or similar means as those used to install the platform, e.g., through use of work ships, scaffolding, or other similar methods.

Embodiments described herein thereby provide temporary platforms and methods by which additional surface space can be provided to an offshore structure, usable for a large variety of purposes, that can be installed efficiently and inexpensively, and removed and/or repositioned (e.g., repurposed) as needed, also efficiently and inexpensively. The embodied platforms and methods comprise temporary additions to an offshore structure and thus avoid various regulations and requirements for permanent additions, while providing a stable surface directly attached to the offshore structure, that is not subject to the negative effects of wave motion or other forces, while avoiding both the large cost for rental of vessels. Further, the embodied platforms and methods can be used with a wide range of offshore structures, independent of the specific dimensions or features thereof, due to the ability of the platforms to be placed at any desired height and/or horizontal position.

While various embodiments usable within the scope of the present disclosure have been described with emphasis, it should be understood that within the scope of the appended claims, the present invention can be practiced other than as specifically described herein.

What is claimed is:

1. A method for using a temporary platform in conjunction with an offshore structure, the method comprising the steps of:

securing a plurality of clamps to an existing portion of the offshore structure at different vertical heights;

securing a receiver member to the plurality of clamps at a selected horizontal position;

securing the temporary platform to the receiver member, wherein an entire weight of the receiver member and the temporary platform is supported by the plurality of clamps; and moving the temporary platform by:

unlocking the plurality of clamps from the offshore structure or the receiver member:

repositioning the receiving member and the temporary platform at a differing height or on a different portion of the offshore structure; and locking the plurality of clamps about the offshore structure or the receiver member.

2. The method of claim 1, wherein the step of securing the plurality of clamps to the existing portion of the offshore structure comprises securing a first portion of the plurality of clamps around a plurality of vertically extending members of the offshore structure, and wherein the step of securing the receiver member to the plurality of clamps comprises securing a second portion of the plurality of clamps around a plurality of horizontally extending portions of the receiver member.

3. The method of claim 2, wherein the step of moving the temporary platform comprises unlocking the first portion of the plurality of clamps; moving the receiver member to the differing height or the differing portion of the offshore structure; and locking the first portion of the plurality of clamps around the plurality of vertically extending members of the offshore structure.

4. The method of claim 2, wherein the step of moving the temporary platform comprises unlocking the first portion of the plurality of clamps; repositioning the clamps and the receiving member at the differing height or on the differing portion of the offshore structure; and securing the temporary platform to the receiving member.

5. The method of claim 4, further comprising the step of repositioning the receiver member to a differing horizontal position by unlocking the second portion of the plurality of clamps, moving the receiver member horizontally, and locking the second portion of the plurality of clamps around the plurality of horizontally extending portions of the receiver member.

6. The method of claim 4, wherein the step of securing the temporary platform to the receiver member comprises connecting the temporary platform to the receiver member by a rotatable joint.

7. The method of claim 1, wherein the step of securing the temporary platform to the receiver member comprises inserting a protruding portion of the temporary platform into a corresponding receptacle within the receiver member.

8. A temporary platform for use with an offshore structure, the temporary platform comprising:

a plurality of clamps removably secured to a portion of the offshore structure at a selected height;

a receiver member removably engaged with the plurality of clamps at a selected horizontal position, wherein the receiver member comprises:

a first elongate horizontal portion;

a second elongate horizontal portion, wherein the plurality of clamps connect the first and the second elongate horizontal portions to the offshore structure;

a plurality of central support members connecting the first elongate horizontal portion with the second elongate horizontal portion; and a platform removably engaged with the receiver member.

9. The temporary platform of claim 8, wherein said at least one of the clamps comprises a central member having a first recession for receiving the portion of the offshore structure and a second recession for receiving the receiver member, a detachable first end member secured to the central member that encloses the portion of the offshore structure between the first end member and the central member, and a detachable second end member secured to the central end member that encloses the receiver member between the second end member and the central member.

10. The temporary platform of claim 8, wherein the platform comprises a protruding portion that engages a corresponding receptacle in the receiving member.

11. The temporary platform of claim 8, wherein the plurality of clamps comprises a first clamp and a second clamp engaged to a first elongate vertical member of the offshore structure, and a third clamp and a fourth clamp engaged to a second elongate vertical member of the offshore structure, and wherein a first elongate horizontal portion of the receiver member engages the first clamp and the third clamp and a second elongate horizontal portion of the receiver member engages the second clamp and the fourth clamp.

12. The temporary platform of claim 11, wherein the receiver member comprises a plurality of tubular members extending from the first elongate horizontal portion, the second elongate horizontal portion, or combinations thereof, each of said tubular members having a bore therein for receiving a protruding member of the temporary platform.

13. The temporary platform of claim 8, further comprising a first plurality of lateral support members extending from the first elongate horizontal portion and a second plurality of lateral support members extending from the second elongate horizontal portion, wherein at least a portion of the first and second plurality of lateral support members are configured generally parallel relative to each other.

14. The temporary platform of claim 13, wherein the receiver member is connected to the platform by a rotatable joint.

15. The temporary platform of claim 14, wherein the receiver member further comprises a plurality of C-shaped channels that receive a portion of the platform and support at least a portion of the weight of platform.

16. The temporary platform of claim 8, wherein the platform comprises a plurality of platform sections, wherein each platform section is connected to the receiver member, another platform section, or combinations thereof.

17. A platform assembly for removable engagement with an offshore structure, the platform assembly comprising:

a plurality of connectors, wherein each of said connectors comprises a first portion adapted for removably engaging a support member of the offshore structure and a second portion;

a structural member comprising:

an upper horizontal member;

a lower horizontal member, wherein the upper and lower horizontal members removably engage the second portion of the plurality of connectors;

a plurality of central support members connecting the upper horizontal member with the lower horizontal member;

an upper plurality of lateral members extending from the upper horizontal member; and a lower plurality of lateral members extending from the lower horizontal member, wherein at least a portion of the upper and lower plurality of lateral members are positioned generally parallel relative to each other, a platform surface; and a plurality of fasteners removably connecting the structural member and the platform surface, wherein the entire weight of the platform surface is supported by the structural member.

18. The platform assembly of claim 17, wherein the platform surface comprises a plurality of platform members, and wherein each of said platform members engages a respective portion of the structural member.

19. The platform assembly of claim 17, wherein the plurality of fasteners comprise a plurality of pin joints.

20. The platform assembly of claim 17, wherein the plurality of fasteners comprise a plurality of threaded joints, clamp joints, portions of the platform being inserted into portions of the structural member, or a combination thereof.

* * * * *